US005423632A

United States Patent [19]

Ekvall et al.

[11] Patent Number: 5,423,632

[45] Date of Patent: Jun. 13, 1995

[54] COMPLIANT PLATFORM WITH SLIDE CONNECTION DOCKING TO AUXILIARY VESSEL

[75] Inventors: Anders G. C. Ekvall; Early B. Denison, both of Houston, Tex.

[73] Assignee: Shell Oil Company, Houston, Tex.

[21] Appl. No.: 24,583

[22] Filed: Mar. 1, 1993

[51] Int. Cl.[6] ..... E02B 17/00

[52] U.S. Cl. ..... 405/223.1; 114/249; 114/250; 405/195.1; 405/224

[58] Field of Search ..... 405/224, 195.1, 203; 114/250, 249

[56] References Cited

U.S. PATENT DOCUMENTS

| | | | |
|---|---|---|---|
| 3,111,692 | 11/1963 | Cox . | |
| 3,255,627 | 6/1966 | Doig et al. | 73/151 |
| 3,430,601 | 3/1969 | Thompson | 114/249 X |
| 3,504,740 | 4/1970 | Manning . | |
| 3,645,225 | 2/1972 | Lunde | 114/249 X |
| 3,717,002 | 2/1973 | O'Brien et al. . | |
| 3,727,414 | 4/1973 | Davies . | |
| 3,798,916 | 3/1974 | Schwemmer . | |
| 3,890,916 | 6/1975 | Tummers et al. | 114/219 |
| 4,066,030 | 1/1978 | Milone | 114/250 X |
| 4,156,577 | 5/1979 | McMakin . | |
| 4,185,694 | 1/1980 | Horton | 166/350 |
| 4,492,270 | 1/1985 | Horton . | |
| 4,494,738 | 1/1985 | Britton et al. | 267/140 |
| 4,497,593 | 2/1985 | Kramer | 405/212 |
| 4,633,953 | 1/1987 | LeBoeuf et al. . | |
| 4,643,614 | 2/1987 | Laursen . | |
| 4,694,771 | 9/1987 | Poldervaart et al. | 114/230 |
| 4,721,412 | 1/1988 | King et al. . | |
| 4,735,526 | 5/1988 | Kawagoe et al. . | |
| 4,740,109 | 4/1988 | Horton . | |
| 4,754,817 | 7/1988 | Goldsmith . | |
| 4,784,529 | 11/1988 | Hunter . | |
| 4,793,737 | 12/1988 | Shotbolt | 405/169 |
| 4,893,965 | 1/1990 | Jordan . | |
| 4,907,657 | 3/1990 | Cox . | |
| 4,907,912 | 3/1990 | Smith . | |
| 4,907,996 | 3/1990 | Poldervaart | 441/3 |
| 4,913,238 | 4/1990 | Danazcko et al. . | |
| 4,934,871 | 6/1990 | Kazokas, Jr. . | |
| 4,966,495 | 10/1990 | Goldman . | |
| 4,972,907 | 11/1990 | Sellars, Jr. . | |
| 4,973,198 | 11/1990 | Cox . | |
| 4,995,762 | 2/1991 | Goldman . | |
| 5,159,891 | 11/1992 | Lohr et al. | 114/230 |
| 5,190,411 | 3/1993 | Huete et al. . | |
| 5,195,848 | 3/1993 | Huete et al. . | |
| 5,199,821 | 4/1993 | Huete et al. . | |
| 5,207,534 | 5/1993 | Brasted et al. . | |

FOREIGN PATENT DOCUMENTS

| | | | |
|---|---|---|---|
| 499859 | 12/1950 | Belgium | 114/250 |
| WO85/01927 | 5/1985 | WIPO . | |

OTHER PUBLICATIONS

"Conoco Readies Jolliet TLWP for Nov. 1 Startup," *Ocean Industry,* pp. 17–21 (Oct,.1989).

H. I. Knecht and M. E. Nagel, "Field Experience Proves Semisubmersible Drilling Tender Concept," *Offshore,* pp. 56–57 (Sep. 1990).

Kerckhoff et al., "Minifloater: A Deepwater Production Alternative," *Ocean Industry,* pp. 147–152 (Sep. 1990).

Chitwood et al., "Semisubmersible Drilling Tender Unit," *SPE Drilling Engineering,* pp. 104–110 (Jun. 1987).

*Primary Examiner*—Dennis L. Taylor

*Attorney, Agent, or Firm*—Mark A. Smith

[57] ABSTRACT

An improved method for conducting offshore well operations is disclosed in which a compliant platform is installed adjacent a selected well site and an auxiliary vessel is temporarily docked to the compliant platform to provide for support for the well operations which will be produced through the compliant platform. In the practice of the improved method, the compliant platform is isolated from vertical loads upon the auxiliary vessel docked thereto during the performance of well operations conducted for the compliant platform by the offshore auxiliary vessel. Another aspect of the present invention is an improved system for restraining an offshore drilling vessel temporarily to a compliant platform which uses a slide-connection for isolating the compliant platform from vertical loads upon the offshore drilling vessel during the well operations.

15 Claims, 5 Drawing Sheets

40
42
40A
48
10
10A
26
24
60A
22
12
50
50
20
54
52
46
16
28
44
44A
14
44

40
60A
10
10C
16

40
60A
10D
52
52
16
28
44A

FIG. 4A
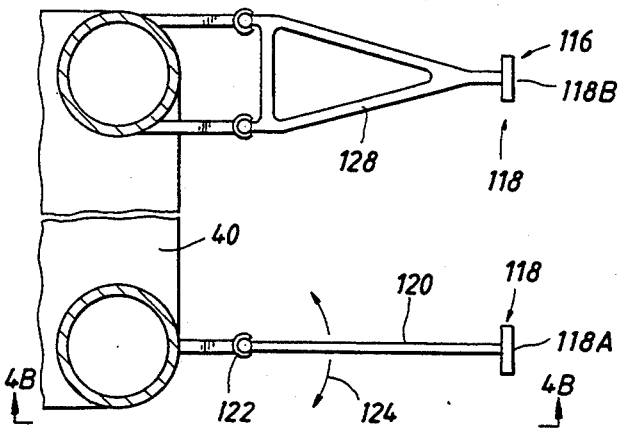
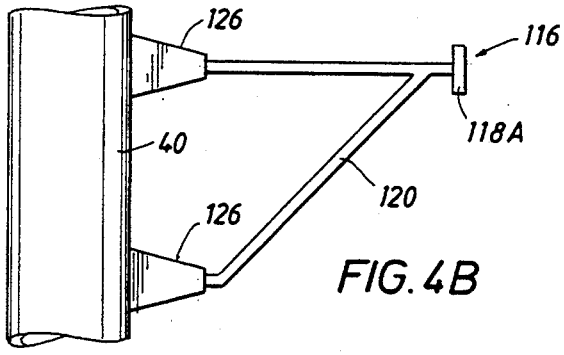
FIG. 4B
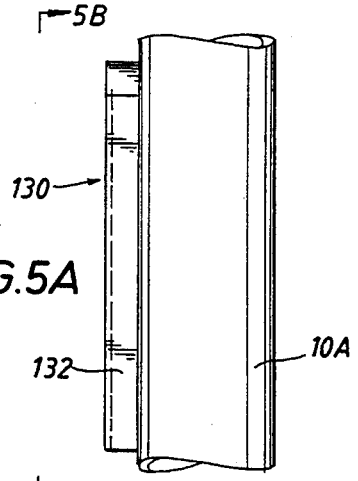
FIG. 5A
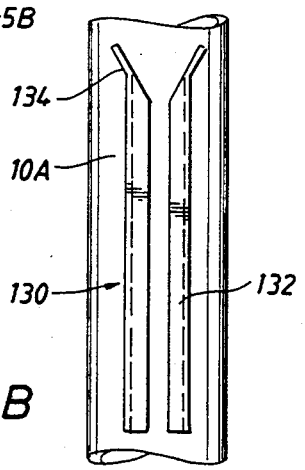
FIG. 5B
FIG. 8
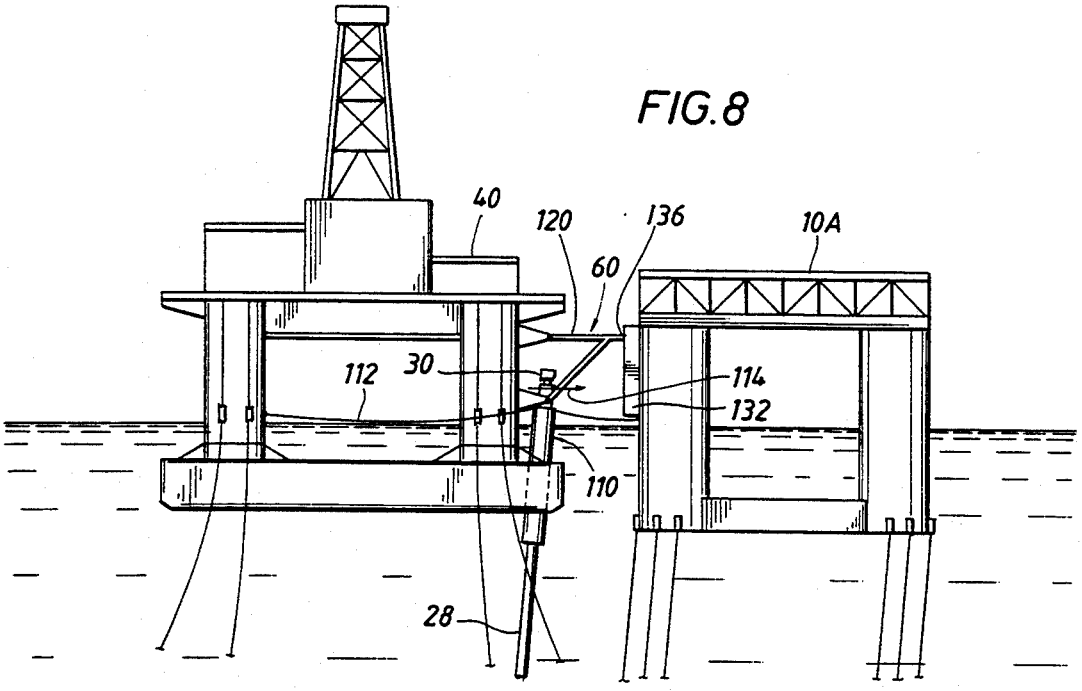

COMPLIANT PLATFORM WITH SLIDE CONNECTION DOCKING TO AUXILIARY VESSEL

BACKGROUND OF THE INVENTION

The present invention relates to a method for conducting well operations for offshore reservoirs. More particularly, the present invention relates to a system and method for docking an auxiliary vessel to a compliant platform in support of well operations.

Traditional bottom-founded platforms having fixed or rigid tower structures have been taken to their logical depth limits in the development of offshore oil and gas reserves. Economic considerations suggest that alternatives to this traditional technology be used in deep waters.

Alternative designs have been developed for various configurations of "compliant platforms", e.g., tension leg, compliant tower, and articulated tower platforms as well as floating production systems, which can provide drilling and production facilities in deepwater at costs less than those of traditional fixed platforms.

Further economies and benefits have been provided to the use of such compliant platforms by the recent development of a method for conducting well operations for offshore wells as disclosed in U.S. patent application Ser. No. 919,630 filed Dec. 10, 1990, by Huete et al for a Method for Conducting Offshore Well Operations, which is hereby incorporated herein by reference and made a part thereof. This document discloses an offshore drilling vessel which is docked to the compliant platform and is driven out of substantially vertical alignment over the well site in order to align a drilling derrick of the offshore drilling vessel thereover. Well operations are then conducted from the drilling vessel and the production riser is transferred from the vessel to the compliant platform. This method facilitates supporting well operations with an auxiliary vessel for surface accessible completions which are then hung on a deepwater compliant platform. This permits the use of a compliant platform which does not have to be scaled to accommodate the weight of a major drilling rig and permits well operation facilities supplied by the auxiliary vessel to relocate when those facilities are not needed at the platform.

However, the auxiliary vessel and the compliant platform respond to environmental loads from wind, wave and current unequally and out of phase. Traditional docking methods will tend to transmit vertical loads from the auxiliary vessel to the compliant platform as the docking elements resist relative motion therebetween. Increasing the capacity of the compliant platform to accommodate such temporary load conditions works against some of the principle benefits of this method of conducting well operations.

Thus, there is a need for a restraining or docking system that better facilitates the use of auxiliary vessels in support of well operations for compliant platforms.

SUMMARY OF THE INVENTION

Toward the fulfillment of this need, the present invention is an improved method for conducting offshore well operations in which a compliant platform is installed adjacent a selected well site and an auxiliary vessel is temporarily docked to the compliant platform to provide for support for the well operations which will be produced through the compliant platform. In the practice of the improved method, the compliant platform is isolated from vertical loads upon the auxiliary vessel docked thereto during the performance of well operations conducted for the compliant platform by the offshore auxiliary vessel.

Another aspect of the present invention is an improved system for restraining an offshore drilling vessel temporarily to a compliant platform to provide well operations in support of the compliant platform which uses a slide-connection for isolating the compliant platform from vertical loads upon the offshore drilling vessel during the well operations.

BRIEF DESCRIPTION OF THE DRAWINGS

The brief description above, as well as further objects, features and advantages of the present invention will be more fully appreciated by reference to the following detailed description of the preferred embodiments which should be read in conjunction with the accompanying drawings in which:

FIG. 4A is a top plan view of docking elements of a docking system in accordance with the present invention.

FIG. 4B is a side elevation view of a docking element of a docking system in accordance with the present invention taken along line 4A–4B in FIG. 4A.

FIG. 5A is a side elevation view of a docking element suitable to receive the docking element of FIG. 4B.

FIG. 5B is a front elevation view of the docking element of FIG. 5A taken along line 5B—5B in that Figure.

FIG. 8 is a side elevation view of a semisubmersible platform transferring a riser to a compliant platform which is docked thereto in accordance with a practice of the present invention.

DETAILED DESCRIPTION OF PREFERRED EMBODIMENTS

Figure 1:
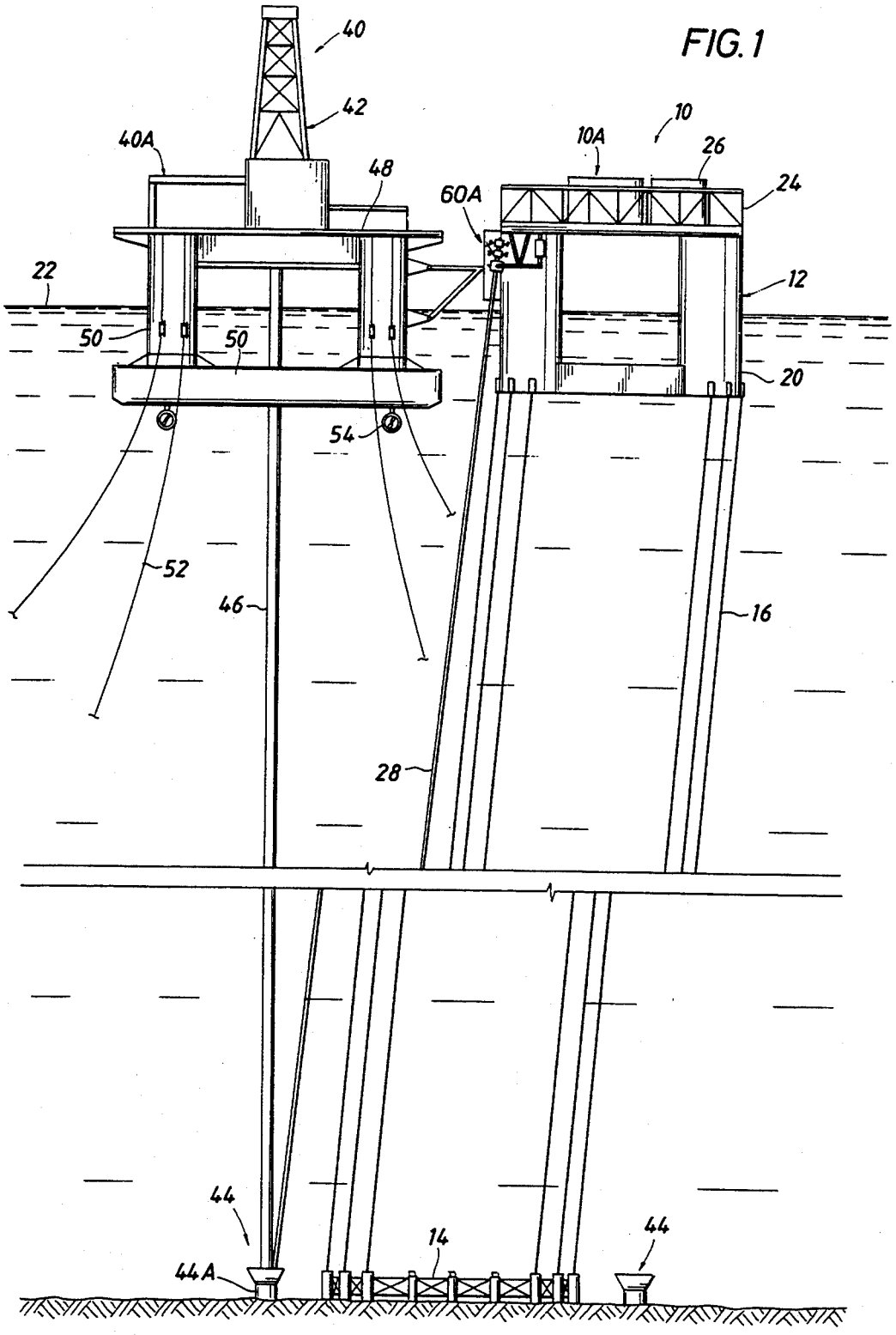
FIG. 1 is a side elevation view of a semisubmersible vessel docked to a tension leg well jacket ("TLWJ") in accordance with the present invention.

FIG. 1 is a side elevation view of a docking system and operations practiced in accordance with the present invention with compliant platform 10 docked to offshore drilling vessel 40, here a semisubmersible vessel 40A.

In this illustration, compliant platform 10 is provided by a tension leg well jacket ("TLWJ") 10A which has a floating superstructure 12 secured to a foundation 14 with a plurality of tendons or tension legs 16 which draw buoyant hull 20 of superstructure 12 below its free-floating draft at ocean surface 22. Hull 20 supports a deck 24 which carries processing facilities 26.

Semisubmersible vessel 40A is illustrated conducting drilling operations with derrick and related drilling facilities 42 supported on deck 48 which is in turn supported by pontoons, columns or other buoyant members 50. The derrick of the semisubmersible vessel is positioned over one of the well sites 44, here at well site 44A, using a catenary mooring system 52 or dynamic positioning thrusters 54 and drilling operations are conducted through a drilling riser 46. A production riser 28 of a previously drilled well is supported by tension leg well jacket 10A with the valve assembly of the surface completion or Christmas tree 30 supported above the ocean's surface in a tensioning system 118.

Offshore drilling vessel 40 interfaces with compliant platform 10 through a slide-connection docking system 60, here provided by sliding bearing joint 60A.

Figure 1A:
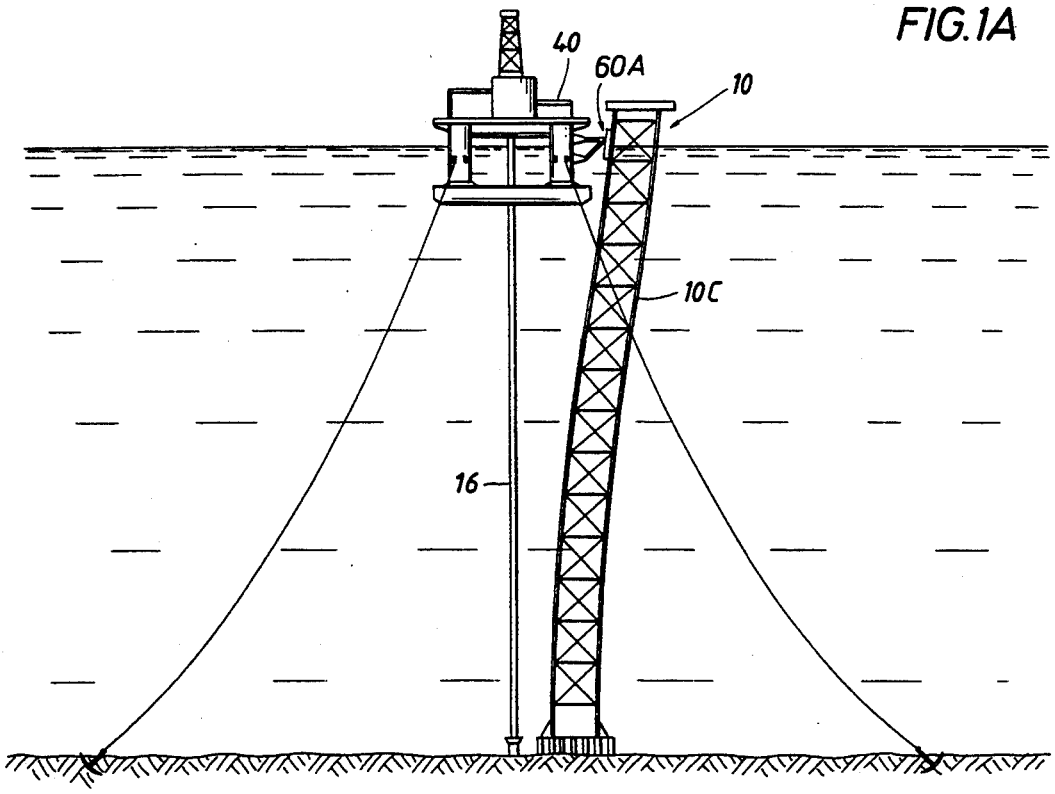
FIG. 1A is a side elevation view of an alternate embodiment of the practice of the present invention in which a semisubmersible vessel is docked to a compliant tower platform.
Figure 1B:
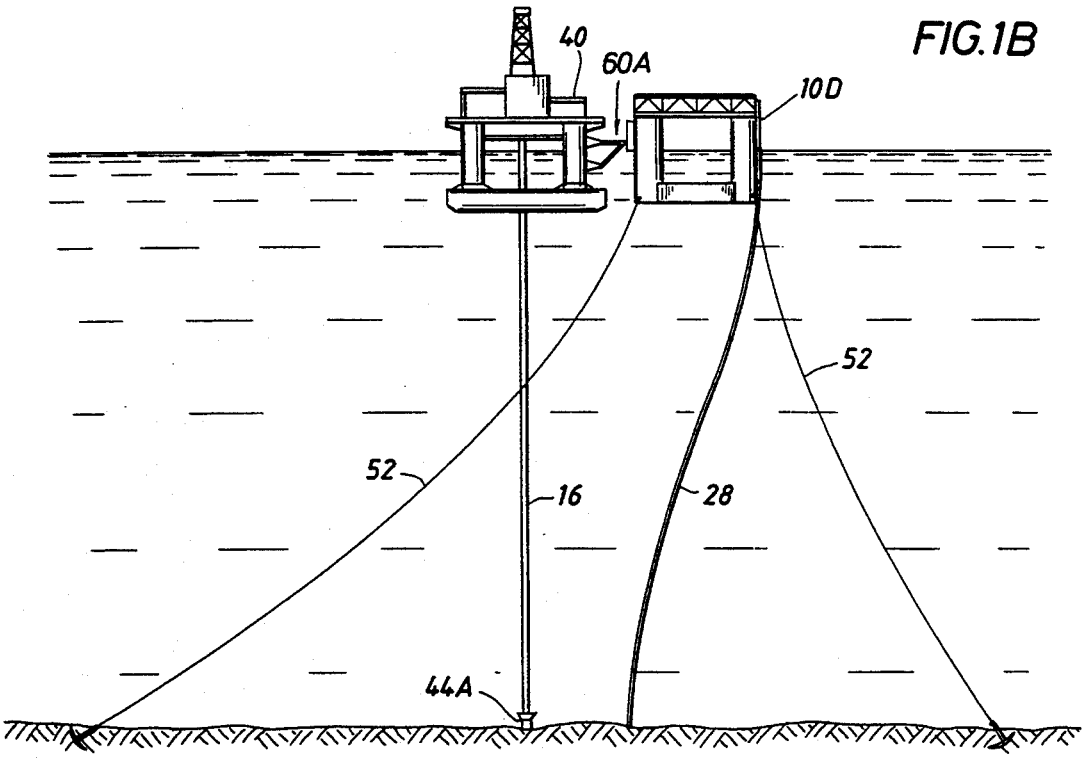
FIG. 1B is a side elevation view of an alternate embodiment of the practice of the present invention in which a semisubmersible vessel is docked to a floating production system ("FPS").

A full range of different compliant platforms can be adapted for use in the practice of the present invention and FIGS. 1A and 1B represent a sample of the breadth of practicing this invention. FIG. 1A is an alternate embodiment of the practice of the present invention in which compliant platform 10 is provided by a compliant tower 10C which is assisted by drilling from offshore drilling vessel 40. FIG. 1B is an alternative embodiment of the practice of the present invention in which an offshore drilling vessel 40 is connected through a slide-connection docking system 60 to a floating production system 10D which has its own positioning system with catenary mooring lines 52. In this embodiment the floating production system is positioned so that the offshore drilling vessel connected to it will be brought into place over a selected well site 44A for drilling operations.

The present invention facilitates conducting well operations for a compliant platform from an auxiliary vessel. A "compliant" platform is any offshore surface facility designed to "give" in a controlled manner with environmental loading rather than rigidly resist such force. This basic design precept distinguishes the fixed or rigid bottom-founded towers which require vast amounts of structural materials for extension into deep water. Many basic configurations of compliant platforms have been proposed including articulated towers, compliant towers, compliant piled towers, tension leg platforms, etc., a sampling of which are illustrated in the FIG. 1 series discussed above. However, any basic configuration which is compliant, favorably economically sensitive to load reductions, and adapted to receive laterally transferred production risers is well suited for use in the practice of the present invention. FIGS. 2 through 8 illustrate the practice of the present invention in support of a tension leg well jacket which is a minimal tension leg platform without drilling capabilities, and, at most, modest workover capabilities. However, those skilled in the art and familiar with the teachings of this application could apply this practice to any other basic compliant platform configuration.

Figure 2:
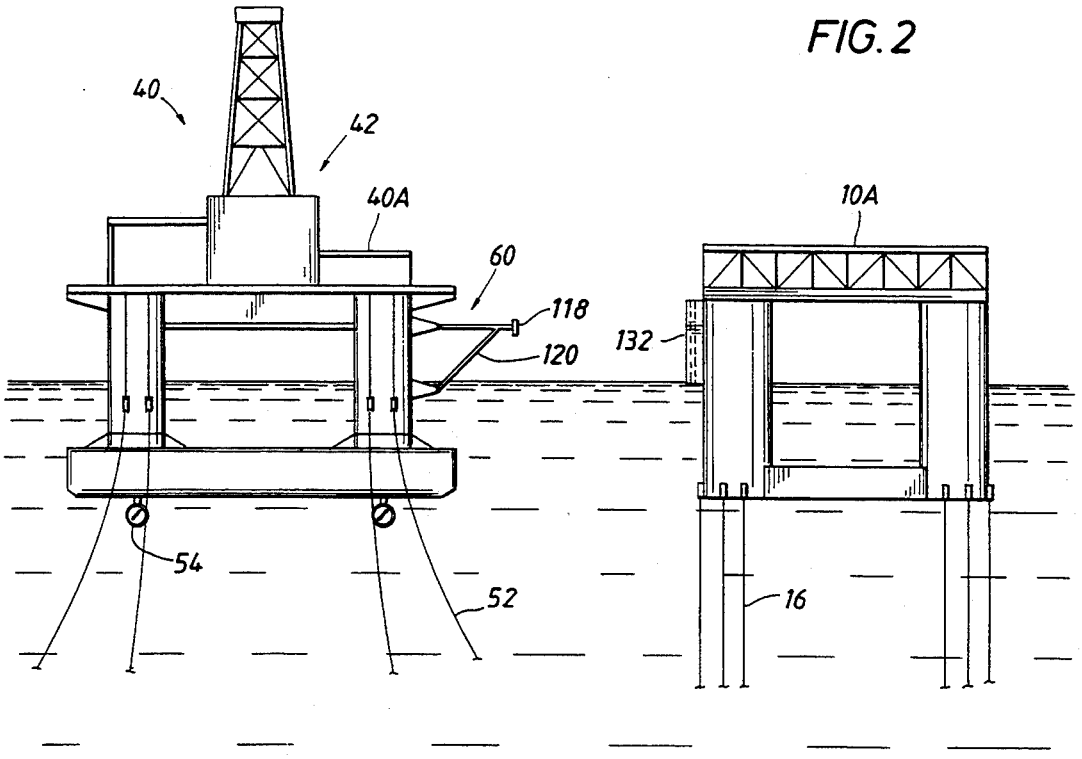
FIG. 2 is a side elevation view of a docking approach for a semisubmersible vessel and a compliant platform which are about to dock in accordance with the present invention.
Figure 3:
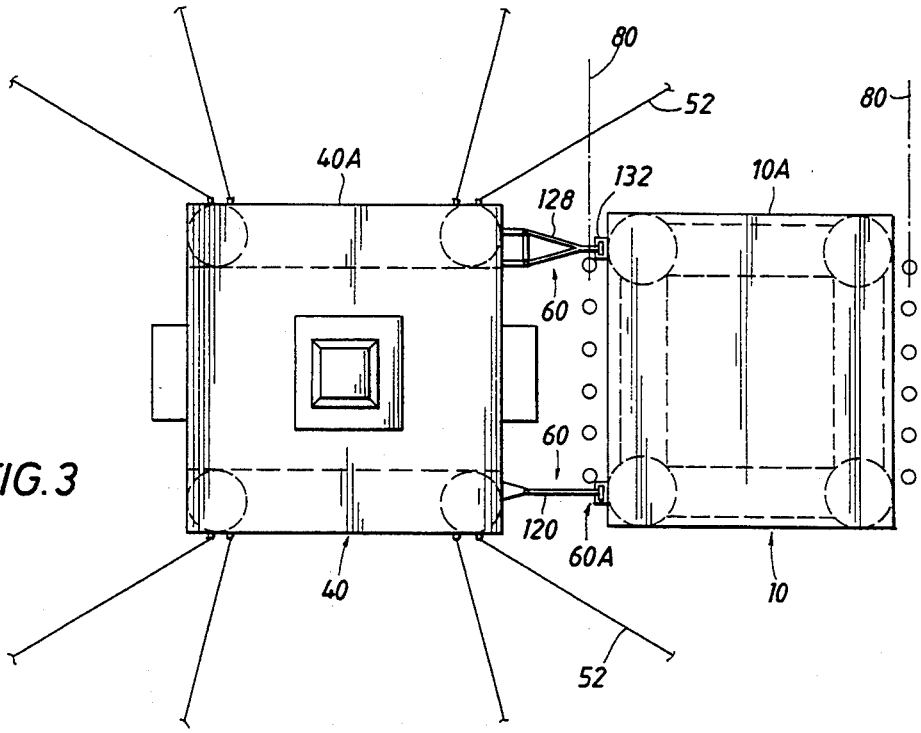
FIG. 3 is a top plan view of a semisubmersible vessel and a compliant platform completing docking operations in accordance with the practice of an embodiment of the present invention.

FIG. 2 illustrates deployment of offshore drilling vessel 40 adjacent installed tension leg well jacket 10A. The offshore drilling vessel is a floating structure which carries a derrick, drawworks and related drilling facilities 42. Further, the term "offshore drilling vessel" is intended to cover any transportable, floating facilities of an auxiliary vessel capable of supporting well operations such as drilling, completion, workover, well repair or abandonment. Preferably, these facilities are provided in a substantially open design adapted for stability in deepwater drilling applications. Semisubmersible vessels represent a class of vessels well suited to this application and have been used throughout to generally illustrate the practice of the present invention.

Semisubmersible vessel 40A in FIG. 2 is maneuverable by either catenary mooring lines 52 or dynamic positioning thrusters 54. For purposes of this embodiment of the practice, the catenary mooring lines are deployed and anchored in a spread about the semisubmersible vessel which overlaps the position of the tension leg well jacket. Semisubmersible vessel 40A can then be maneuvered with respect to tension leg well jacket 10A by playing out and retrieving selected catenary mooring lines 52.

FIG. 4A is an overhead view of one embodiment of first engaging member 116, here provided by keys 118. A first key 118A is extended outboardly from swinging strut 120 which is connected to offshore drilling vessel 40 in a manner affording rotation in a horizontal plane around pivot axis 122 of hinge 126. See arrows 124 and FIG. 4B. Returning to FIG. 4A, a second key 118B is presented upon rigid frame strut 128.

FIG. 5A is a side view of a second engaging member 130 mounted on TLWJ 10A, here provided by vertically extending track 132. Track 132 is configured to receive key 118 in a vertically sliding connection 136. Sliding connection 136 is one means for restraining the offshore vessel 40 with respect to compliant platform 10 while isolating compliant platform from vertical loads upon the docking elements or restraining system 60. This particular means of restraint provides a direct, positive horizontal engagement and is suitable for very close restraint to facilitate the type of well operations disclosed in patent application Ser. No. 918,914 as well as the method of patent application Ser. No. 919,630, referenced above. U.S. patent application Ser. No. 918,914, filed Jul. 23, 1992 by Brasted et al for a Method for Conducting Offshore Well Operations, which is a continuation of application Ser. No. 624,867 filed Dec. 10, 1990, is hereby incorporated by reference and made a part hereof.

Other sliding bearing connections will be apparent to those having ordinary skill in the art from a review of the present disclosure. Those providing direct, positive horizontal engagement through sliding connections or bearings must provide a reliable sliding action that will prevent jamming. However, other restraining means such as an indirect restraint in which both the compliant tower and the offshore drilling vessel are each provided with independent mooring lines may also be used to isolate vertical loading across the relative restraint of the compliant platform and the offshore drilling vessel.

In the illustrated embodiment, key 118 is insertable into track entry 134 (see FIG. 5B) during docking procedures which are otherwise much the same as described in application Ser. No. 919,630, referenced above, however, these docking operations require vertical alignment of keys 116 and track entry 134 such as by adjusting the balance of offshore drilling vessel 40.

Key 118 of the swinging strut is first engaged with a corresponding track 132 and ballast is adjusted to secure the received key in sliding engagement within track 132 away from track entry 134. Offshore drilling vessel 40 is then rotated to bring key 118B on rigid strut frame 128 into sliding engagement within a second track 134. Further ballast adjustments may be necessary to vertically align key 118 with the second track and it is preferred that the track entries of the respective tracks be such that the same ballast level will not release both keys 118 from reception within their respective tracks.

Tracks 132 are open-ended in the illustrated embodiment and keys 118 may enter at either the upper or lower end. It may also be desired to provide a flaired track entry on at least one of tracks 112 to facilitate reception of the key. In an alternative embodiment, the ends of the tracks might be closed with a "keyhole" track entry provided at one end of the track.

It may also be preferred that the interface between keys 118 and track 132 provide a certain amount of flexure and angular resilience such as by providing an elastomeric flex joint between keys 118 and their respective strut member.

Figure 6:
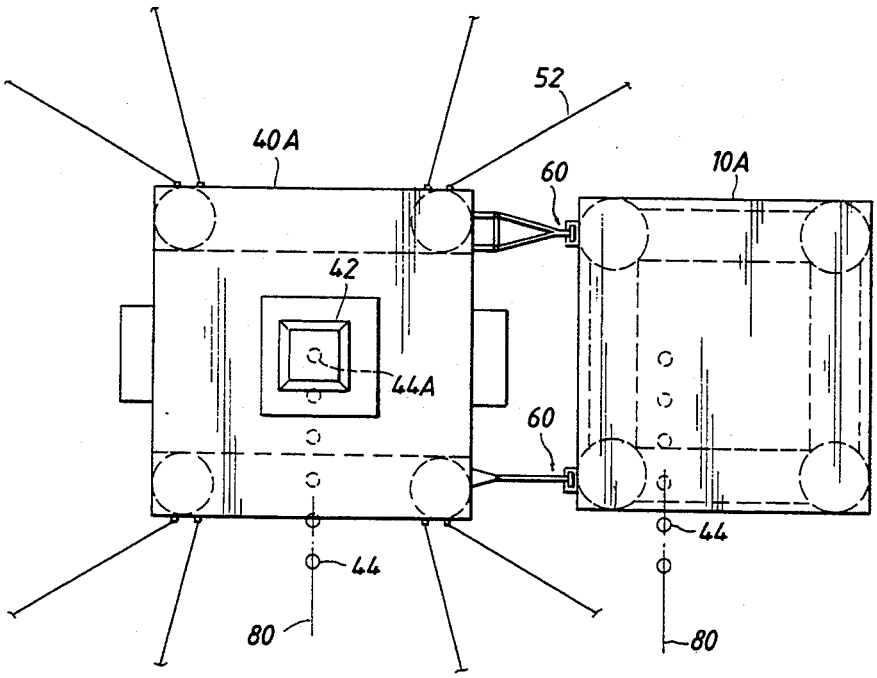
FIG. 6 is a top plan view of a semisubmersible vessel docked to a compliant platform in accordance with the practice of an embodiment of the present invention and taking position for drilling operations over a selected well site.
Figure 7:
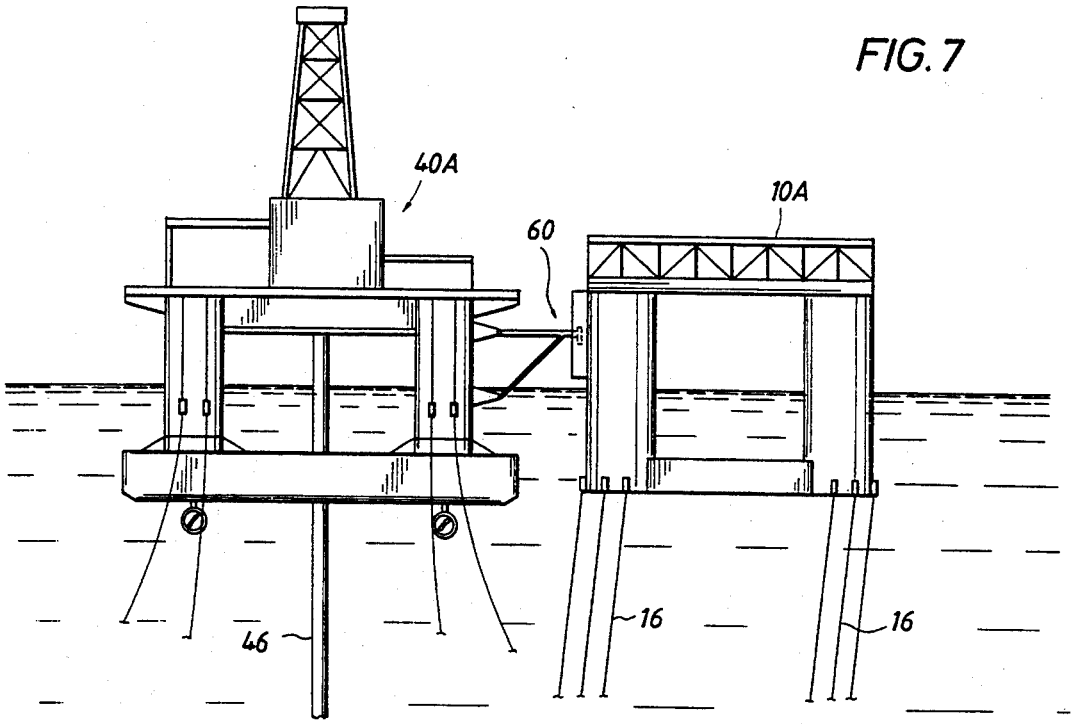
FIG. 7 is a side elevation view of a semisubmersible vessel docked with a compliant platform in accordance with the practice of an embodiment of the present invention and conducting drilling operations.

Docking facilitates moving tension leg well jacket 10A with positioning systems carried on semisubmersible vessel 40A. Compare FIG. 3 in which tension leg well jacket 10A is normally centered between well lines 80 at the periphery of the tension leg well jacket with FIG. 6 wherein the catenary mooring lines 52 have been adjusted to bias tension leg well jacket 10A out of alignment with its nominal position and to bring the derrick and related drilling facilities 42 into alignment with a selected well site 44A. The semisubmersible vessel of FIG. 6 is in position to initiate drilling or other well operations through a drilling riser 46 as further illustrated in FIG. 7. The drilling operations are best undertaken in substantially vertical drilling risers and the ability to shift compliant platform 10 slightly out of alignment with its nominal resting position in order to place the derrick over a selected well site substantially enhances drilling efficiency and reduces equipment wear. This ability also allows continuing drilling operations once the tension leg well jacket is in place and thereby allows production to come onstream as soon as wells are completed, even as the drilling program proceeds.

After drilling or other well operations are performed, drilling riser 46 may be replaced with a lighter weight production riser 28 and the drilling facilities on offshore drilling vessel 40 are used through the production riser to complete the well. After completion of the well and installation of a surface christmas tree 30, a temporary buoyancy module 110 is installed about the production riser and the production riser is passed or transferred to compliant platform 10, here tension leg well jacket 10A. See FIG. 8. Alternatively, a temporary small workover rig may be installed on tension leg well jacket 10A and used to install the production riser and complete the well.

Guylines 112 are used to draw production riser 28 to tension leg well jacket 10A. Alternatively, the natural righting ability of temporary buoyancy module 110 is used to maintain production riser 28 in place while catenary mooring lines 52 are adjusted to bring tension leg well jacket 10A into position to receive the substantially stationary production riser 28. The presently preferred method for undertaking this transfer is a combination of both the methods.

Copending U.S. patent application Ser. No. 919,629 filed Jul. 24, 1992, which is a continuation of application Ser. No. 624,864 filed Dec. 10, 1990, by D. A. Huete et al, for a Method for Conducting Offshore Well Operations is hereby incorporated by reference and made a part hereof. That application together with applications Ser. Nos. 918,914 and 919,630, referenced above, provide further details of the general use and benefits of the methods of conducting well operations facilitated by the present invention.

A number of variations have been disclosed for docking systems and techniques for joining offshore vessel and structures in a manner which isolates each from the transmission of vertical loads from the other. As noted above, this docking system and technique are uniquely suited to, but in its broadest elements not limited to, providing temporary facilities of an offshore vessel to a tension leg well jacket for conducting well operations. Other modifications, changes and substitutions are intended in the foregoing disclosure. Further, in some instances, some features of the present invention will be employed without a corresponding use of other features described in these preferred embodiments. Accordingly, it is appropriate that the appended claims be construed broadly and in a manner consistent with the spirit and scope of the invention herein.

What is claimed is:

1. An improved method for conducting offshore well operations from a tension leg platform moored with at least one tendon, in which the tension leg platform is installed adjacent a selected well site; and an auxiliary vessel is temporally docked to the compliant platform with facilities on board for support of well operations; the improvement comprising:

protecting the tendon of the tension leg platform from excessive vertical loading transmitted through a docking system by isolating the tension leg platform from vertical loads acting upon the auxiliary vessel during well operations conducted for the tension leg platform by the offshore auxiliary vessel.

2. An improved method for conducting well operations in accordance with claim 1, wherein isolating the tension leg platform from vertical loads upon the auxiliary vessel comprises:

docking the auxiliary vessel to the tension leg platform through a vertically sliding connection.

3. A improved method for conducting well operations in accordance with claim 2, further comprising:

providing a plurality of first engaging members on the auxiliary vessel;

providing a plurality of second engaging members on the tension leg platform; and releasably securing said first and second engaging members in a vertically sliding connection such that the auxiliary vessel is free to move vertically with respect to the tension leg platform.

4. An improved method for conducting well operations in accordance with claim 3 wherein the method conducts well operations from a derrick facility on the auxiliary vessel which is vertically aligned with a well bay of the tension leg platform and a well on an ocean floor.

5. An improved method for conducting well operations in accordance with claim 3 wherein the tension leg platform is brought out of alignment with a well on an ocean floor and the auxiliary vessel restrained with respect to the tension leg platform is brought into substantially vertical alignment therewith.

6. An improved method for conducting offshore well operations from a tension leg platform secured to the ocean floor through a plurality of tendons, in which a tension leg platform is restrained out of its normal position substantially over a well pattern;

an offshore drilling vessel is positioned over a selected well site of the well pattern at a location at the surface of the water not accessible to the offshore drilling vessel with the tension leg platform in its normal position; and well operations are conducted through a substantially vertical riser, the improvement comprising:

protecting the tendons of the tension leg platform from excessive vertical loading by isolating the tension leg platform from vertical loads upon the offshore drilling vessel during well operations conducted for the tension leg platform by the offshore drilling vessel.

7. An improved method for conducting well operations in accordance with claim 6, wherein isolating the tension leg platform from vertical loads upon the offshore drilling vessel comprises:

docking the offshore drilling vessel to the tension leg platform through a vertically sliding connection.

8. A improved method for conducting well operations in accordance with claim 7, further comprising:

providing a plurality of first engaging members on the offshore drilling vessel;

providing a plurality of second engaging members on the tension leg platform; and releasable securing said first and second engaging members in a vertically sliding connection such that the offshore drilling vessel is free to move vertically with respect to the tension leg platform.

9. A improved method for conducting well operations in accordance with claim 8, wherein releasable securing said first and second engaging members further comprises:

adjusting the ballast of the offshore drilling vessel to bring a key presented by one of the first engaging members into alignment with a track entry to a vertical track providing one of the second engaging members;

moving the key into the track entry; and adjusting the ballast of the offshore drilling vessel to secure the key within the track by taking the key out of alignment with the track entry.

10. An improved method for conducting well operations in accordance with claim 9, wherein additional first and second engaging members are provided with additional keys and corresponding track entries at relative positions such that ballast levels aligning the additional keys and track entries will maintain the engagement of the first key within its corresponding track, said method further comprising:

further adjusting the ballast of the offshore drilling vessel and swinging the offshore drilling vessel with respect to the tension leg platform to align the additional keys and track entries;

moving the additional keys into the corresponding track entries while maintaining the engagement of the first key within its track; and adjusting the ballast of the offshore drilling vessel to secure the additional keys into additional vertically extending tracks.

11. In an improved system for restraining an offshore drilling vessel temporarily to a tension leg platform, which is moored with a plurality of tendons, to provide well operations in support of the tension leg platform, the improvement comprising:

a slide-connection for isolating the tension leg platform from vertical loads upon the offshore drilling vessel during the well operations, whereby the tendons of the tension leg platform are protected from excessive transfer of components of vertical load from the offshore drilling vessel to the tension leg platform.

12. An improved system for restraining an offshore drilling vessel in accordance with claim 11, wherein said slide-connection further comprises:

a strut connected to the offshore drilling vessel and extending outwardly therefrom;

a key presented on the outboard end of the strut; and a vertically extending track configured to receive the key in a vertically slidable engagement.

13. An improved system for restraining an offshore drilling vessel in accordance with claim 12 further comprising a plurality of corresponding keys and tracks presented by the offshore drilling vessel and tension leg platform, respectively.

14. An improved system for restraining an offshore drilling vessel in accordance with claim 13, wherein said tension leg platform is a tension leg well jacket.

15. A system for restraining an offshore drilling vessel temporarily to a tension leg platform, which is moored with a plurality of tendons, to provide well operations in support of the tension leg platform, comprising:

an elongated swinging strut connected to the offshore drilling vessel in a horizontally pivoting connection and projecting outboardly;

a first key presented on the outboard end of the swinging strut;

a rigid frame strut connected to the offshore drilling vessel and projecting outwardly therefrom;

a second key presented on the outboard end of the frame strut;

first and second tracks presented on the tension leg platform and disposed to receive the fast and second keys, respectively, in a vertically extended sliding reception; and track entries into the first and second tracks to accept entry of the first and second keys, respectively;

whereby the offshore drilling vessel may be docked to the tension leg platform without subjecting the tendons of the tension leg platform with vertical loads transmitted across the system.

* * * * *